US006162117A

United States Patent [19]

Vo

[11] Patent Number: 6,162,117

[45] Date of Patent: Dec. 19, 2000

[54] NAIL BUFFING TOOL

[76] Inventor: Quynh M. Vo, 3790 Fishinger Blvd., Columbus, Ohio 43026

[21] Appl. No.: 09/332,419

[22] Filed: Jun. 14, 1999

[51] Int. Cl.[7] ..... B24B 23/00; B24B 27/08

[52] U.S. Cl. ..... 451/358; 451/178; 451/344; 451/541

[58] Field of Search ..... 451/344, 342, 451/526, 533, 534, 540, 544, 360

[56] References Cited

U.S. PATENT DOCUMENTS

| | | | |
|---|---|---|---|
| 294,766 | 3/1884 | Coy | 451/533 |
| 2,772,524 | 12/1956 | Kopczynski | 451/541 |
| 2,796,705 | 6/1957 | Miller et al. | 451/541 |
| 3,142,138 | 7/1964 | Kean et al. | 451/541 |
| 3,364,630 | 1/1968 | Rusk et al. | 451/541 |
| 4,606,154 | 8/1986 | Herrmann et al. | 451/533 |
| 5,235,716 | 8/1993 | Stella | 451/358 |
| 5,564,969 | 10/1996 | Tsang | 451/358 |
| 5,765,256 | 6/1998 | Allan et al. | 451/533 |
| 5,775,981 | 7/1998 | Yang | 451/358 |
| 5,941,764 | 8/1999 | Yang | 451/358 |

OTHER PUBLICATIONS

Salon Ware Catalog—1998—Cover Page and Pages 50, 51 and 71.

Nailco Salon Market Place Catalog—Aug.–Dec. 1998; Cover Page and Pages 46–61.

*Primary Examiner*—Derris H. Banks

*Attorney, Agent, or Firm*—Kremblas, Foster, Phillips & Pollick

[57] ABSTRACT

A nail buffing tool for use with a powered drill is disclosed, with the buffing tool having a shaft connected to the drill, a hub, a nail contacting layer, and a compressive layer intermediate the nail contacting layer and the hub. The nail contacting layer is on the exterior of the tool, the nail contacting layer comprises abrasive grit, and the hub is connected to the shaft. Preferably, the compressive layer is fabricated from a foamed substance. The thickness of the compressive layer relative to the hub engaging layer is not as fixed, however, in the preferred embodiment of the invention it would probably be thicker than the hub engaging layer. Similarly, the thickness of the compressive layer relative to the diameter of the hub is not as fixed, although in the preferred embodiment of the invention it would be less than the diameter of the hub. In a modified embodiment is an artificial nail buffing tool for use with a powered drill tool having a drill bit having a shaft and a hub connected thereto, with the artificial nail buffing tool having a hub engaging layer, a compressive layer, and a nail contacting layer on the exterior of the buffing tool. The hub engaging layer is intermediate the hub and the compressive layer, and the compressive layer is intermediate the nail contacting layer and the hub engaging layer. The abrasive grit can either be secured to the nail contacting layer by a material or secured directly thereto.

20 Claims, 3 Drawing Sheets

NAIL BUFFING TOOL

BACKGROUND OF THE INVENTION

1. Field of the Invention

The present invention relates generally to rotating buffing tools, and more particularly to a tool which can be used with nails, such as fingernails or toenails, whether real or artificial.

2. Description of Related Art

With the growth of the personal healthcare and beauty industry, one of the areas which has experienced phenomenal growth has been the nail industry. It has been estimated that each day between 500,000–1,000,000 individuals receive attention to their nails specifically involving attention to artificial nails. Typically, a nailcare customer returns every two weeks for further attention. Because of this consumer demand, nailcare can now be obtained not only at spas or high end beauty salons, but at barber shops and customized nail boutiques. One of the things that has greatly impacted the industry has been the introduction of artificial fingernails.

The artificial fingernail industry has spawned an industry unto itself. Most salon catalogues devote pages to tools and products which can be used in the application of artificial nails. With respect to the tools associated with the application of artificial nails, there are the nail forms, the drills, various drill bits used in the shaping of the artificial nail, sanders used in smoothing the artificial nail prior to the application of polish, and buffers used just prior to the application of polish.

A typical appointment for a wearer of artificial fingernails includes the following steps. First, the existing nail is filed to eliminate any areas of inconsistency. Then, the actual acrylic nail mixture is applied. Once dry, the artificial nail is shaped into its general shape using an emery board. The next step normally involves the filing of the acrylic to a state of being fairly smooth. Finally, a buffing tool is used on the artificial nail to obtain a smooth, finished appearance. After buffing, cuticle oil and polish may be applied if desired.

While numerous types of bits and sanders have permitted nails to be properly shaped, a problem area remains when it comes to buffing. This problem can best be appreciated by a better understanding of the work-day of an experienced nail professional who may see twenty customers per day, which translates into the buffing of at least two hundred nails. Using small buffers held at the tips of two or three fingers can cause cramping in the applicator's fingers over the course of a day. Consequently, larger rectangularly block-shaped buffers were developed which could be held loosely by all of the fingers in the applicator's hand. To lessen fatigue, some blocks were made using lightweight foam materials, and some were easily compressible by light application of squeezing pressure.

Buffer structure developed such that some blocks featured a plurality of abrasive types on various sides. For example, one side might have a medium grit of abrasive applied thereto, while another side would only have fine grit, and yet another only have coarse grit. While block-shaped buffers did not tire out the applicator's hands as much as the smaller buffing tools, the hands still tired over the course of doing hundreds of nails per day. Additionally, the relatively large size of the blocks made it difficult to easily polish each and every nail to the degree desired. Finally, the necessity of buffing each nail by hand, instead through the use of a machine, continued to make the process extremely time consuming.

As a result, some nail care professionals decided to speed up the buffing process and lessen the fatigue on their hands by using traditional nail care tools designed for the polishing of artificial nails. However, two other problems presented themselves by the used of traditional polishing tools. First, the heat generated by the bit during the time period when it must remain in contact with the nail during the buffing operation can actually cause discomfort to the artificial nail wearer. Second, the abrasive tools used to try to effect the buffing of the artificial nail often resulted in the nail surface not being as smooth as desired, since the goal of the polishing bits was to grind away undesirable bits of acrylic, not the buffing of the acrylic surface.

Atttemps at lessening the detrimental effects of heat in the buffing process described above have caused some nail tool manufacturers to resort to buffing surfaces other than grit abrasives. For example, some artificial nail buffing tools have been developed to use felt or chamois covered drill bits. Regardless of the substance in contact with the artificial nail surface, traditional drill bits have all been formed in essentially the same way.

It is thus apparent that the need exists for a nail buffing tool that can be used on real nails as well as during the application of an artificial nail so as to overcome the problems associated with the prior art. Such a tool should be capable of being used with various brands of drills currently being used in the nail care industry.

BRIEF SUMMARY OF THE INVENTION

There is disclosed a nail buffing tool for use with a powered drill, with the buffing tool having a shaft connected to the drill, a hub, a nail contacting layer, and a compressive layer intermediate the nail contacting layer and the hub. The nail contacting layer is on the exterior of the tool, the nail contacting layer comprises abrasive grit, and the hub is connected to the shaft. The abrasive grit can be made from abrasives including, but not limited to, diamonds, synthetic diamonds, silicon carbide, or aluminum oxide.

The tool may include a hub engaging layer intermediate the hub and the compressive layer. The nail contacting layer comprises a material to which the abrasive grit is secured. The nail contacting layer may be secured to the compressive layer. The hub engaging layer may be secured to the compressive layer. Preferably, the compressive layer is fabricated from a foamed substance. The compressive layer is thicker in dimension than the nail contacting layer. The thickness of the compressive layer relative to the hub engaging layer is not as fixed, however, in the preferred embodiment of the invention it would probably be thicker than the hub engaging layer. Similarly, the thickness of the compressive layer relative to the diameter of the hub is not as fixed, although in the preferred embodiment of the invention it would be less than the diameter of the hub.

There is also disclosed a nail buffing tool for use with a powered drill, with the buffing tool having a shaft connected to the drill, a hub, a hub engaging layer, a nail contacting layer, and a compressive layer intermediate the nail contacting layer and the hub. The nail contacting layer is on the exterior of the tool, the nail contacting layer comprises abrasive grit, and the hub is connected to the shaft. The abrasive grit can be made from abrasives including, but not limited to, diamonds, synthetic diamonds, silicon carbide, or aluminum oxide.

The hub engaging layer is intermediate the hub and the compressive layer, and the compressive layer is intermediate the nail contacting layer and the hub engaging layer. The nail contacting layer comprises a material to which the abrasive grit is secured. The nail contacting layer may be secured to the compressive layer. The hub engaging layer may be secured to the compressive layer. The compressive layer is preferably fabricated from a foamed substance. The tool's compressive layer is preferably thicker in dimension than the nail contacting layer. The thickness of the compressive layer relative to the hub engaging layer is not as fixed, however, in the preferred embodiment of the invention it would probably be thicker than the hub engaging layer. Similarly, the thickness of the compressive layer relative to the diameter of the hub is not as fixed, although in the preferred embodiment of the invention it would be less than the diameter of the hub.

Further, there is disclosed a nail buffing tool for use with a powered drill tool having a drill bit having a shaft and a hub connected thereto, with the artificial nail buffing tool of the invention having a hub engaging layer, a compressive layer, and a nail contacting layer. The nail contacting layer is on the exterior of the buffing tool, and preferably the nail contacting layer is made of abrasive grit, with the abrasive grit being made from an abrasive group which contains diamonds, synthetic diamonds, silicon carbide or aluminum oxide. The hub engaging layer is intermediate the hub and the compressive layer, and the compressive layer is intermediate the nail contacting layer and the hub engaging layer.

One objective of this invention is to provide a nail buffing tool that when used with artificial nails does not cause discomfort to the wearer of the artificial nail during the buffing step of application.

Another objective of this invention is to provide a buffing tool which will result in a desirably smooth nail surface, especially when used in connection with artificial nails.

Still another objective of this invention is to provide a relatively inexpensive nail buffing tool which due to its cost will permit the tool to be thrown away out of concerns for health and sanitation after use when used on a customer of artificial nails.

Still another objective of this invention is to provide an improved buffing tool for use on nails, whether toenails or fingernails, and whether real or artificial.

Other aspects and advantages of the instant invention will be appreciated from the following description, drawings, and the appended claims.

DETAILED DESCRIPTION OF THE INVENTION

Figure 1:
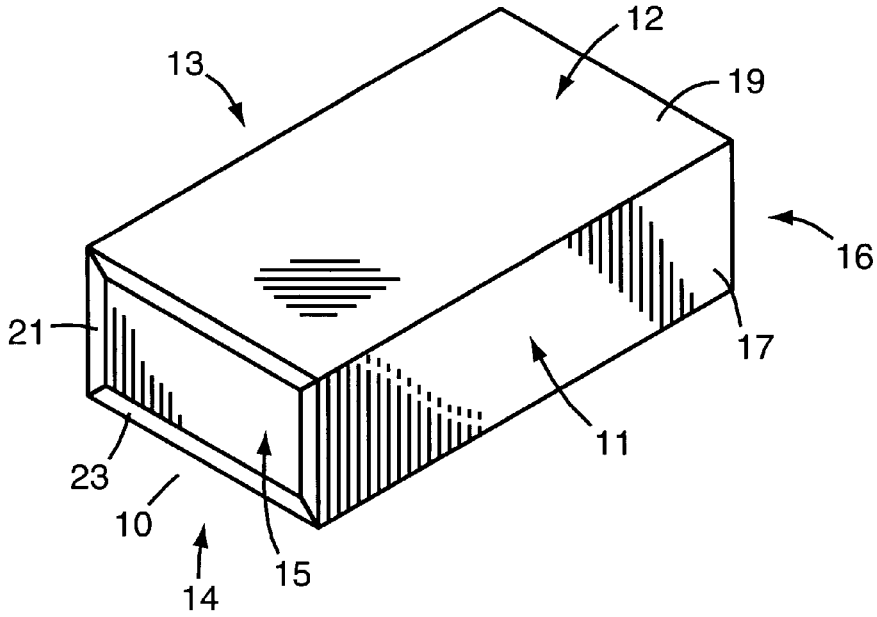
Fig. 1 Prior Art
FIG. 1 is a perspective view of a representative sample of the block-shaped prior art associated with the buffing of nails.

Having reference to the drawings, attention is directed first to FIG. 1 which shows a perspective view of the block-shaped prior art of buffing tools designated generally by the numeral 10. This type of prior art tool features relatively large rectangularly block-shaped buffers which are held loosely by all of the fingers in the applicator's hand. A block of this type has a first side surface 11, a second side surface 12, a third side surface 13, and a fourth side surface, in addition to ends 15 and 16. For example, the block could be 1" wide by 3" long by ¾" tall.

To lessen fatigue, some blocks are made using lightweight foam materials, and some are easily compressible by light application of squeezing pressure. Some of these types of blocks feature a plurality of abrasive types on various sides. For example, one side might have a first abrasive surface 17 of medium grit of abrasive applied thereto, while another side would have a second abrasive surface 19 of fine grit, another would only have a third abrasive surface 21 of coarse grit, and the fourth side would have a fourth abrasive surface 23 of perhaps medium grit.

While block-shaped buffers do not tire out the applicator's hands as much as the smaller buffing tools associated with the prior art that were held by the fingertips, the hands still tire over the course of doing hundreds of nails per day. Also, the relatively large size of the blocks makes it difficult to easily polish each and every nail to the degree desired. Finally, the necessity of buffing each nail by hand, instead through the use of a machine, makes the process extremely time consuming.

Figure 2:
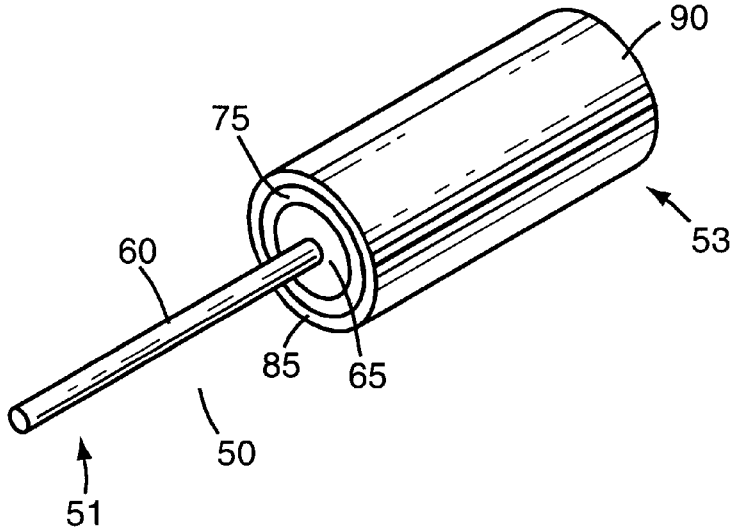
Fig. 2 Prior Art
FIG. 2 is a perspective view of a representative sample of a drill bit for polishing of nails.

As a result, some nail care professionals decided to speed up the buffing process and lessen the fatigue on their hands by using traditional nail care tools designed for the polishing of artificial nails, with such a tool shown in FIG. 2 and designated generally by the numeral 50. The prior art nailcare drill bit 50 includes a drill portion 51 and a tool portion 53. With respect to the drill portion 51, it features a mandrel or shaft 60. With respect to the tool portion it is shown as having a hub 65, and a hard, inflexible intermediate layer 75 surrounded by a nail contacting layer 85.

Regardless of whether the abrasive surface 90 on the nail contacting layer utilizes coarse, medium, fine, extra-fine or super-fine grit size, the use of prior art nailcare drill bits as a buffing tool encounters at least two problems. First, the heat generated by the bit during the time period when it must remain in contact with the nail during the buffing operation can actually cause discomfort to an artificial nail wearer. Second, the abrasive tools used to try to effect the buffing of the artificial nail can result in the nail surface not being as smooth as desired, since the goal of polishing bits is to grind away undesirable bits of acrylic, not the buffing of acrylic surface.

Figure 3:
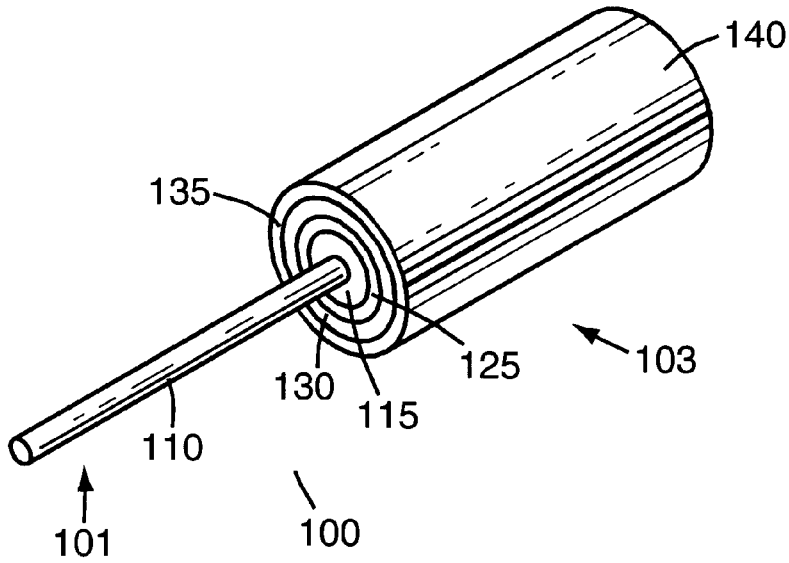
FIG. 3 is a perspective view of an embodiment of the invention.

One embodiment of the nail buffing tool associated with this invention is shown in FIG. 3 and designated generally by the numeral 100. It is comprised of a drill portion 101 and a tool portion 103. The drill portion features a shaft or mandrel 110. Meanwhile, the tool portion has a hub 115, a hub engaging member 125, a compressive layer 130, and a nail contacting layer 135. The buffing tool shown in FIG. 3 is generally cylindrical, although the length of the cylinder as well as its diameter could vary. Regardless of the embodiment, the drawings disclose that the buffing tool has a nail contacting layer having a smooth, non-undulating surface. It is believed that for most cylindrical tools the outside diameter of the tool would be between ⅜" and 1", more preferably between ⅜" and ⅝", and most preferably about ⅜", while the outer diameter associated with the hub would be about ¼". The length of the buffing portion of the tool would be ½" to ¾".

The hub 115 could be fabricated from metal or plastic. The hub engaging member 125 could be fabricated from paper, rubber, or a cloth or fabric material, which fits snugly around the hub. It may fit snugly due to the friction involved, although it could also be secured to the hub, for example by the use of an adhesive. Adjacent to the hub engaging member 125 is a compressive layer 130. The compressive layer may be secured to the hub engaging member, for example by the use of an adhesive. The compressive layer may also be secured to the nail contacting layer, for example by the use of an adhesive.

The compressive layer 130 may be fabricated from a foamed substance with that word being defined for purposes of this invention as including such substances as foam rubber, sponge, or other types of compressible substances referred to in the trade as being a foam object, including, but not limited to, automotive nitrile, and closed cell rubber and plastic products made from urethane, polyurethane or polyethylene, such as the ½" or ¾" width tape sold by Scapa Tapes under serial number SR516V. The thickness of the compressive layer may be thicker, but the preferred thickness is between ⅛" to 3/16".

As far as the nail contacting layer 135 is concerned, it features an abrasive surface 140. The abrasive surface 140 could have coarse, medium, fine, extra-fine or super-fine grit size abrasive, fabricated from abrasive group which contains, but is not limited to diamonds, synthetic diamonds, silicon carbide, or aluminum oxide. Regardless of the embodiment, the abrasive surface covers the entire nail contacting layer of the tool. The nail contacting layer 135 could be fabricated from paper, rubber, or a cloth or fabric material, which fits snugly around the compressive layer. The compressive layer may also be secured to the nail contacting layer, for example by the use of an adhesive.

Figure 4:
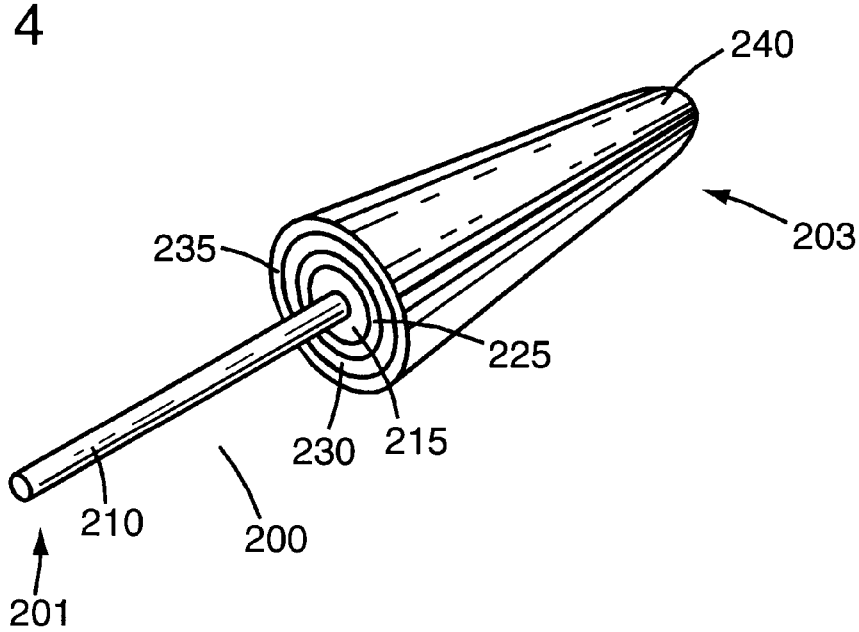
FIG. 4 is a perspective view of a modified embodiment of the invention.

Another embodiment of the nail buffing tool associated with this invention is shown in FIG. 4 and designated generally by the numeral 200. It too is comprised of a drill portion 201 and a tool portion 203. The drill portion features a shaft or mandrel 210. Meanwhile, the tool portion has a hub 215, a hub engaging member 225, a compressive layer 230, and a nail contacting layer 235. The buffing tool shown in FIG. 4 is generally conical, although it should be understood that other tool shapes could be made.

The hub 215 could be fabricated from metal, paper, fabric, or plastic. The hub engaging member 225 could be fabricated from paper, rubber, or a cloth or fabric material, which fits snugly around the hub. It may fit snugly due to the friction involved, although it could also be secured to the hub, for example by the use of an adhesive. Adjacent to the hub engaging member 225 is a compressive layer 230. The compressive layer may be secured to the hub engaging member, for example by the use of an adhesive. The compressive layer may also be secured to the nail contacting layer, for example by the use of an adhesive. The compressive layer 230 may be fabricated from a foamed substance with that word being defined for purposes of this invention as including such substances as foam rubber, sponge, or other types of compressible substances referred to in the trade as being a foam object, including, but not limited to, automotive nitrile, and closed cell rubber and plastic products, made from urethane, polyurethane or polyethylene, such as the ½" or ¾" width tape sold by Scapa Tapes under serial number SR516V. The thickness of the compressive layer may be thicker, but the preferred thickness is between ⅛" to 3/16".

As far as the nail contacting layer 235 is concerned, it features an abrasive surface 240. The abrasive surface 240 could have coarse, medium, fine, extra-fine or super-fine grit size abrasive, fabricated from an abrasive group which contains, but is not limited to diamonds, synthetic diamonds, silicon carbide, or aluminum oxide. The nail contacting layer 235 could be fabricated from paper, rubber, or a cloth or fabric material, which fits snugly around the compressive layer. The compressive layer may also be secured to the nail contacting layer, for example by the use of an adhesive.

Figure 5:
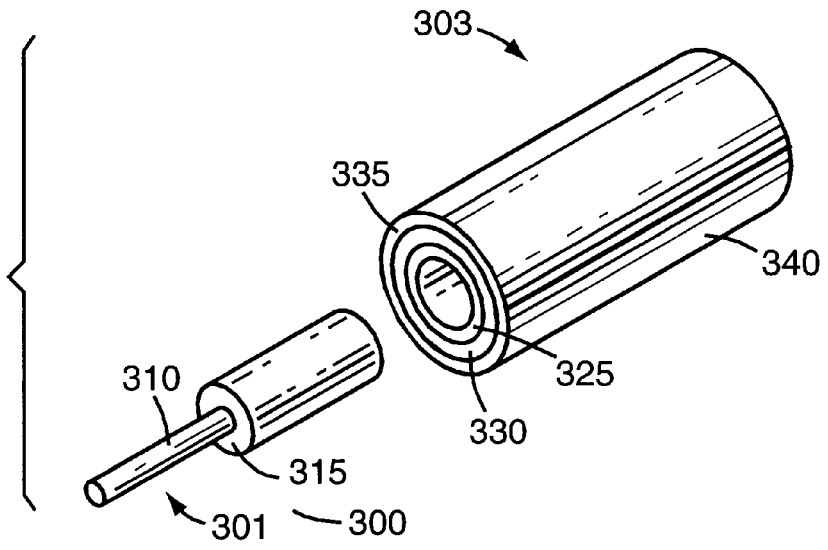
FIG. 5 is an exploded perspective view of a further modified embodiment of the invention.

Yet another modified embodiment of the invention, with this one believed to be the best mode for the practice of the invention, is disclosed in FIG. 5 which shows an exploded perspective view of a modified embodiment of a nail buffing tool, with that tool being designated generally by the numeral 300. It is comprised of a drill portion 301 and a tool portion 303. The drill portion features a shaft or mandrel 310 and a hub 315. Meanwhile, the tool portion has a hub engaging member 325, a compressive layer 330, and a nail contacting layer 335.

The buffing tool shown in FIG. 5 is generally cylindrical, although the length of the cylinder as well as its diameter could vary. It is believed that for most cylindrical tools the outside diameter of the tool would be between ⅜" and 1", more preferably between ⅜" and ⅝", and most preferably about ⅜", while the outer diameter associated with the hub would be about ¼". The length of the buffing portion of the tool would be ½" to ¾".

The hub 315 could be fabricated from metal, paper, fabric, or plastic. The hub engaging member 325 could be fabricated from paper, rubber, or a cloth or fabric material, which fits snugly around the hub. It may fit snugly due to the friction involved, although it could also be secured to the hub, for example by the use of an adhesive. Adjacent to the hub engaging member 325 is a compressive layer 330. The compressive layer may be secured to the hub engaging member, for example by the use of an adhesive.

The compressive layer 330 may be fabricated from a foamed substance with that word being defined for purposes of this invention as including such substances as foam rubber, sponge, or other types of compressible substances referred to in the trade as being a foam object, including, but not limited to, automotive nitrile, and closed cell rubber and plastic products, made from urethane, polyurethane or polyethylene, such as the ½" or ¾" width tape sold by Scapa Tapes under serial number SR516V. The thickness of the compressive layer may be thicker, but the preferred thickness is between ⅛" to 3/16".

As far as the nail contacting layer 335 is concerned, it features an abrasive surface 340. The abrasive surface 340 could have coarse, medium, fine, extra-fine or super-fine grit size abrasive fabricated from an abrasive group which contains, but is not limited to diamonds, synthetic diamonds, silicon carbide, or aluminum oxide. The nail contacting layer 335 could be fabricated from paper, rubber, or a cloth or fabric material, which fits snugly around the compressive layer. The compressive layer may also be secured to the nail contacting layer, for example by the use of an adhesive.

Figure 6:
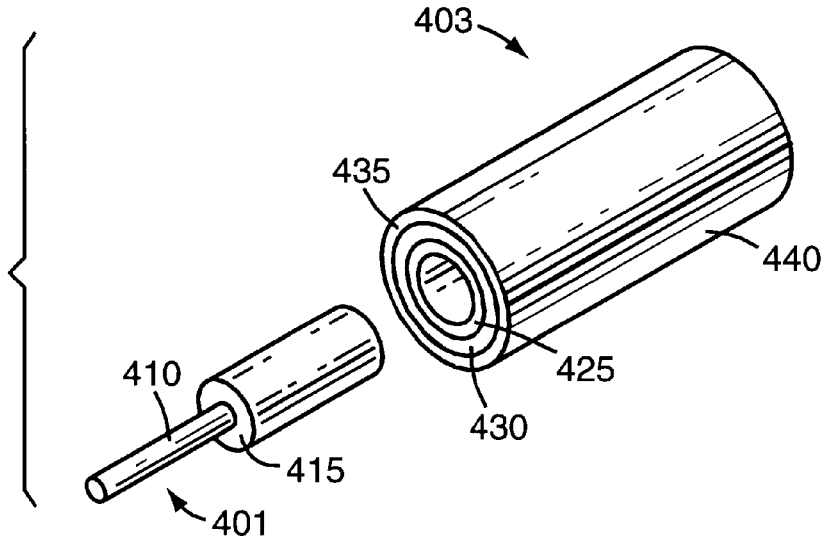
FIG. 6 is an exploded perspective view of a further modified embodiment of the invention.

Still yet another modified embodiment of the invention is disclosed in FIG. 6 which shows an exploded perspective view of a modified embodiment of a nail buffing tool, with that tool being designated generally by the numeral 400. It is comprised of a drill portion 401 and a tool portion 403. The drill portion features a shaft or mandrel 410 and a hub 415. Meanwhile, the tool portion has a hub engaging member 425, a compressive layer 430, and a nail contacting layer 435.

The buffing tool shown in FIG. 6 is generally cylindrical, although the length of the cylinder as well as its diameter could vary. It is believed that for most cylindrical tools the outside diameter of the tool would be between ⅜" and 1", more preferably between ⅜" and ⅝", and most preferably about ⅜", while the outer diameter associated with the hub would be about ¼". The length of the buffing portion of the tool would be ½" to ¾".

The hub 415 could be fabricated from metal, paper, fabric, or plastic. The hub engaging member 425 could be fabricated from paper, rubber, or a cloth or fabric material, which fits snugly around the hub. It may fit snugly due to the friction involved, although it could also be secured to the hub, for example by the use of an adhesive. Adjacent to the hub engaging member 425 is a compressive layer 430. The compressive layer may be secured to the hub engaging member, for example by the use of an adhesive. The compressive layer may also be secured to the nail contacting layer, for example by the use of an adhesive. However, in this embodiment of the invention, the abrasive grit is secured directly to the compressive layer without the presence of a material backing for the grit.

The compressive layer 430 may be fabricated from a foamed substance with that word being defined for purposes of this invention as including such substances as foam rubber, sponge, or other types of compressible substances referred to in the trade as being a foam object, including, but not limited to, automotive nitrile, and closed cell rubber and plastic products, made from urethane, polyurethane or polyethylene, such as the ½" or ¾" width tape sold by Scapa Tapes under serial number SR516V. The thickness of the compressive layer may be thicker, but the preferred thickness is between ⅛" to 3/16".

As far as the nail contacting layer 435 is concerned, it features an abrasive surface 440. The abrasive surface 440 could have coarse, medium, fine, extra-fine or super-fine grit size abrasive, fabricated from an abrasive group which contains, but is not limited to diamonds, synthetic diamonds, silicon carbide, or aluminum oxide.

The nail buffing tool associated with this invention requires less time to complete the buffing of the nails, as well as cause less wear and tear on the applicator's hands and fingers. The well-defined surfaces make it easier to get around the corners of the nail, as well as get near the cuticle. Due to the relatively low cost involved with each of the tools of the invention, especially the embodiment shown in FIGS. 5 and 6, such a tool could be disposable, which has ramifications with respect to health concerns and sanitation.

While the nail buffing tool herein described constitutes the preferred embodiment of the invention, it is to be understood that the invention is not limited to this precise form of nail buffing tool and that changes may be made therein without departing from the scope of the invention which is defined in the appended claims.

What is claimed is:

1. A nail buffing tool for use with a powered drill comprising a shaft, said shaft for connection to the drill, a hub, said hub connected to said shaft, a nail contacting layer, said nail contacting layer being on the exterior of said tool, said nail contacting layer having a smooth, non-undulating surface and comprising abrasive grit, and a compressive layer intermediate said nail contacting layer and said hub, said compressive layer being formed from a material having a thickness in the range of ⅛" to 3/16" which layer is compressed upon the application of pressure to the nail contacting layer.

2. The tool according to claim 1, wherein the abrasive grit is selected from an abrasive group comprising diamonds, synthetic diamonds, silicon carbide, and aluminum oxide.

3. The tool according to claim 1, which includes a hub engaging layer intermediate said hub and said compressive layer.

4. The tool according to claim 1, wherein said nail contacting layer comprises a material to which said abrasive grit is secured.

5. The tool according to claim 1, wherein said abrasive grit is secured to said nail contacting layer.

6. The tool according to claim 1, wherein said nail contacting layer is secured to said compressive layer.

7. The tool according to claim 1, wherein said compressive layer is fabricated from a foamed substance.

8. The tool according to claim 7, wherein said foamed substance is selected from one of the following: foam rubber, sponge, or another compressible substance including, but not limited to, automotive nitrile, and closed cell rubber and plastic products made from urethane, polyurethane or polyethylene.

9. The tool according to claim 1, wherein said compressive layer is thicker in dimension than said hub engaging layer.

10. A nail buffing tool for use with a powered drill tool having a drill bit comprising a shaft and a hub connected thereto, the artificial nail buffing tool comprising a compressive layer, and a nail contacting layer, said nail contacting layer being on the exterior of said buffing tool, said nail contacting layer comprising abrasive grit, said compressive layer being intermediate said nail contacting layer and said hub, said compressive layer being formed from a material having a thickness in the range of ⅛" to 3/16" which layer is compressed upon the application of pressure to the nail contacting layer.

11. The tool according to claim 10, wherein said nail contacting layer comprises a material to which said abrasive grit is secured.

12. The tool according to claim 10, wherein said abrasive grit is secured to said nail contacting layer.

13. The tool according to claim 10, wherein said nail contacting layer is secured to said compressive layer.

14. The tool according to claim 10, wherein said compressive layer is fabricated from a foamed substance.

15. The tool according to claim 14, wherein said foamed substance is selected from one of the following: foam rubber, sponge, or another compressible substance including, but not limited to, automotive nitrile, and closed cell rubber and plastic products made from urethane, polyurethane or polyethylene.

16. The tool according to claim 10, wherein said compressive layer is thicker in dimension than said nail contacting layer.

17. A nail buffing tool for use with a powered drill tool having a drill bit comprising a shaft and a hub connected thereto, the artificial nail buffing tool comprising a compressive layer, and a nail contacting layer, said nail contacting layer being on the exterior of said buffing tool, said nail contacting layer comprising abrasive grit, said abrasive grit covering the entire nail contacting layer, said compressive layer being intermediate said nail contacting layer and said hub, said compressive layer being formed from a material having a thickness in the range of ⅛" to 3/16" which layer is compressed upon the application of pressure to the nail contacting layer.

18. The tool according to claim 17, wherein said abrasive grit is selected from an abrasive group comprising diamonds, synthetic diamonds, silicon carbide, and aluminum oxide.

19. The tool according to claim 17, wherein said compressive layer is fabricated from a foamed substance, said foamed substance being selected from one of the following:

foam rubber, sponge, or another compressible substance including, but not limited to, automotive nitrile, and closed cell rubber and plastic products made from urethane, polyurethane or polyethylene.

20. The tool according to claim 17, wherein said compressive layer is thicker in dimension than said nail contacting layer.

* * * * *